US008370998B2

(12) United States Patent
Han et al.

(10) Patent No.: US 8,370,998 B2
(45) Date of Patent: Feb. 12, 2013

(54) STRAP CONNECTING MEMBER AND ELECTRONIC DEVICE WITH THE STRAP CONNECTING MEMBER

(75) Inventors: Ping Han, Shenzhen (CN); Zhi-Hui Shen, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 220 days.

(21) Appl. No.: 12/962,596

(22) Filed: Dec. 7, 2010

(65) Prior Publication Data

US 2012/0102691 A1 May 3, 2012

(30) Foreign Application Priority Data

Oct. 28, 2010 (CN) ..... 2010 1 0523199

(51) Int. Cl.
*A44B 11/16* (2006.01)
*A44C 5/22* (2006.01)

(52) U.S. Cl. ..... 24/68 J; 24/265 WS

(58) Field of Classification Search ..... 224/176; 24/163 R, 265 WS, 68 R, 71.1, 68 J, 68 B, 24/68 E, 68 SK
See application file for complete search history.

(56) References Cited

U.S. PATENT DOCUMENTS 1,313,644 A * 8/1919 Simon ..... 224/176
1,817,475 A * 8/1931 Becker ..... 224/176

* cited by examiner

*Primary Examiner* — James Brittain
(74) *Attorney, Agent, or Firm* — Altis Law Group, Inc.

(57) ABSTRACT

The electronic device includes a body, a strap, and a strap connecting member. The strap connecting member further includes a pin, a torsion spring one end of which is connected to the pin, a receiving chamber accommodating the pin and defining an opening notch passing through the sidewall thereof, and a cover connected with the torsion spring and engaging with the receiving chamber. The strap is double-layered. The double-layered strap forms a folded end and an open end, the folded end is connected with the pin and is wrapped around the pin, and the open end is separated into two portions which pass at the opening notch and are respectively connected to the body. When the torsion spring is elastically deformed and generates a torsion force, the pin is rotated and the strap automatically shrinks in the receiving chamber under the torsion force.

10 Claims, 5 Drawing Sheets

STRAP CONNECTING MEMBER AND ELECTRONIC DEVICE WITH THE STRAP CONNECTING MEMBER

BACKGROUND

1. Technical Field

The present disclosure relates to wearable electronic devices and, particularly, to a strap connecting member and an electronic device with the strap connecting member.

2. Description of Related Art

Wearable electronic devices, such as a wristwatch, usually include a wrist strap, which includes a number of clasps. A user usually selects one clasp to fasten the wristwatch on his/her wrist according to the size of the wrist. However, the position of each clasp is fixed on the strap and the size of each wrist is different. While a fixed clasp on the strap is easy to tighten and loosen, it could not fit comfortably for some wrist sizes.

Therefore, what is needed is an electronic device with a strap connecting member to overcome the described shortcoming.

DETAILED DESCRIPTION

Figure 1:
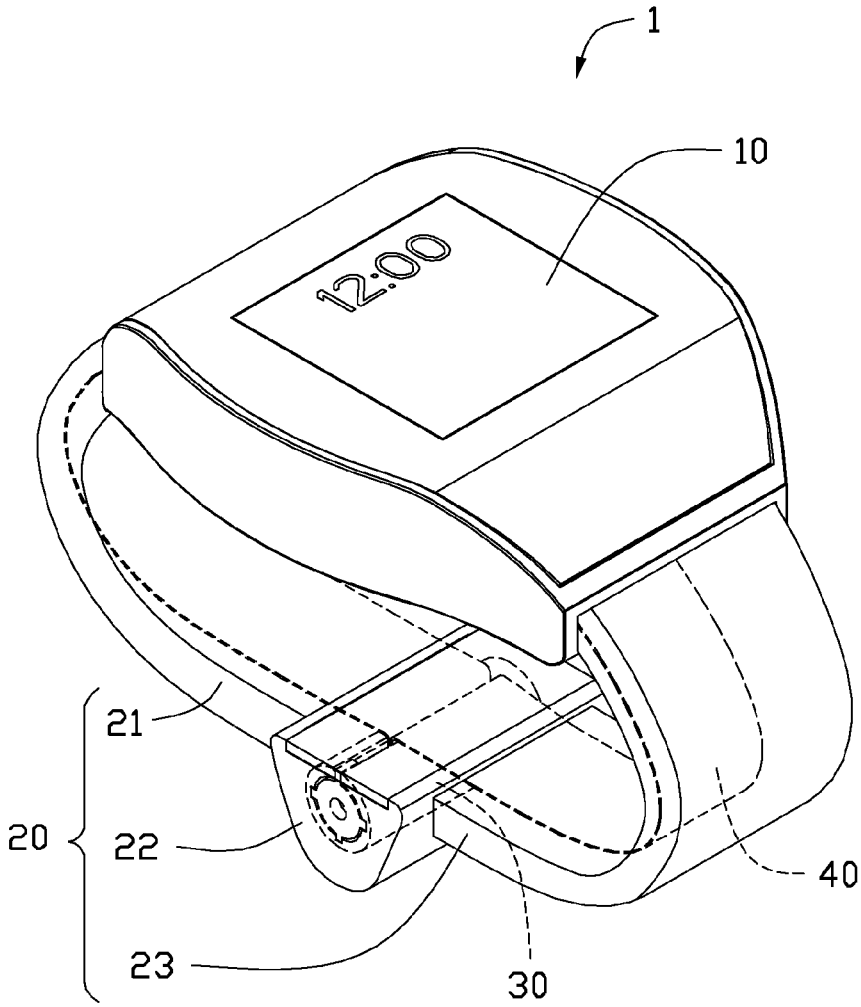
FIG. 1 is an isometric view of an electronic device with a strap connecting member, in accordance with an exemplary embodiment.
Figure 2:
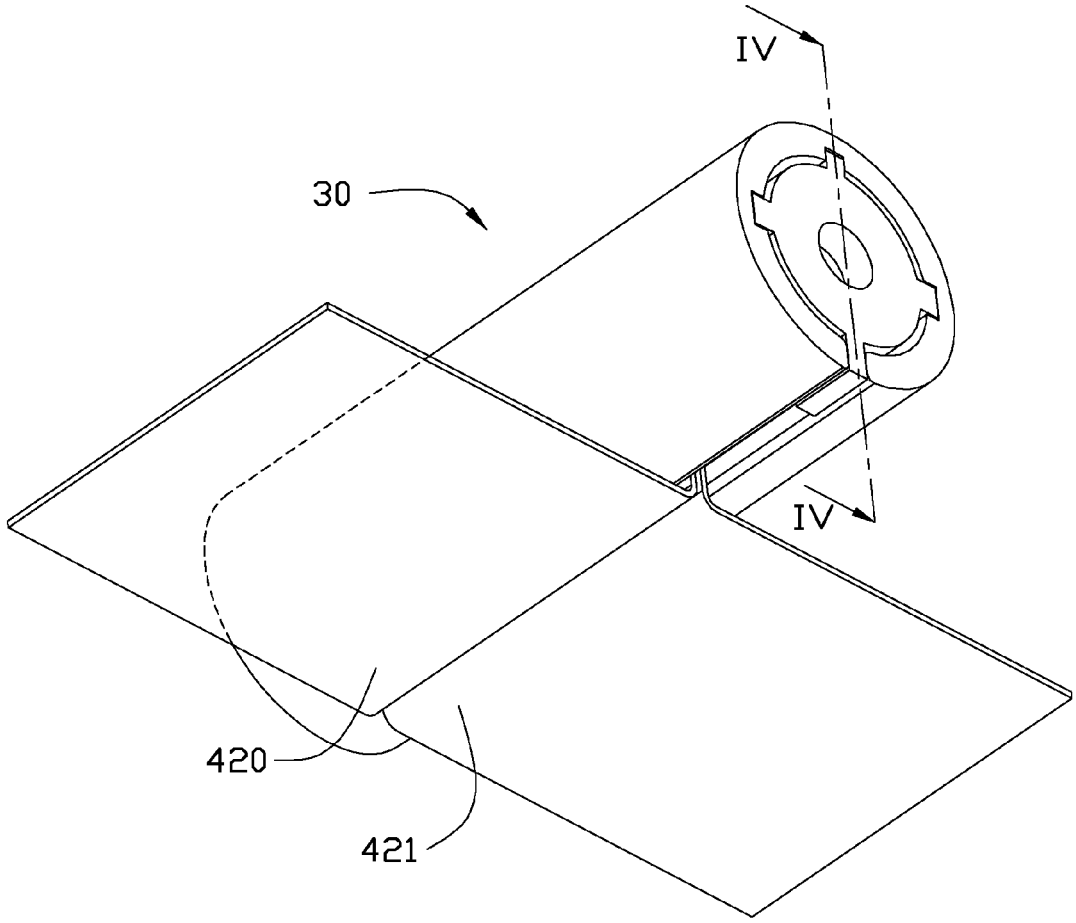
FIG. 2 is an isometric view of the strap connecting member of the electronic device of FIG. 1.
Figure 3:
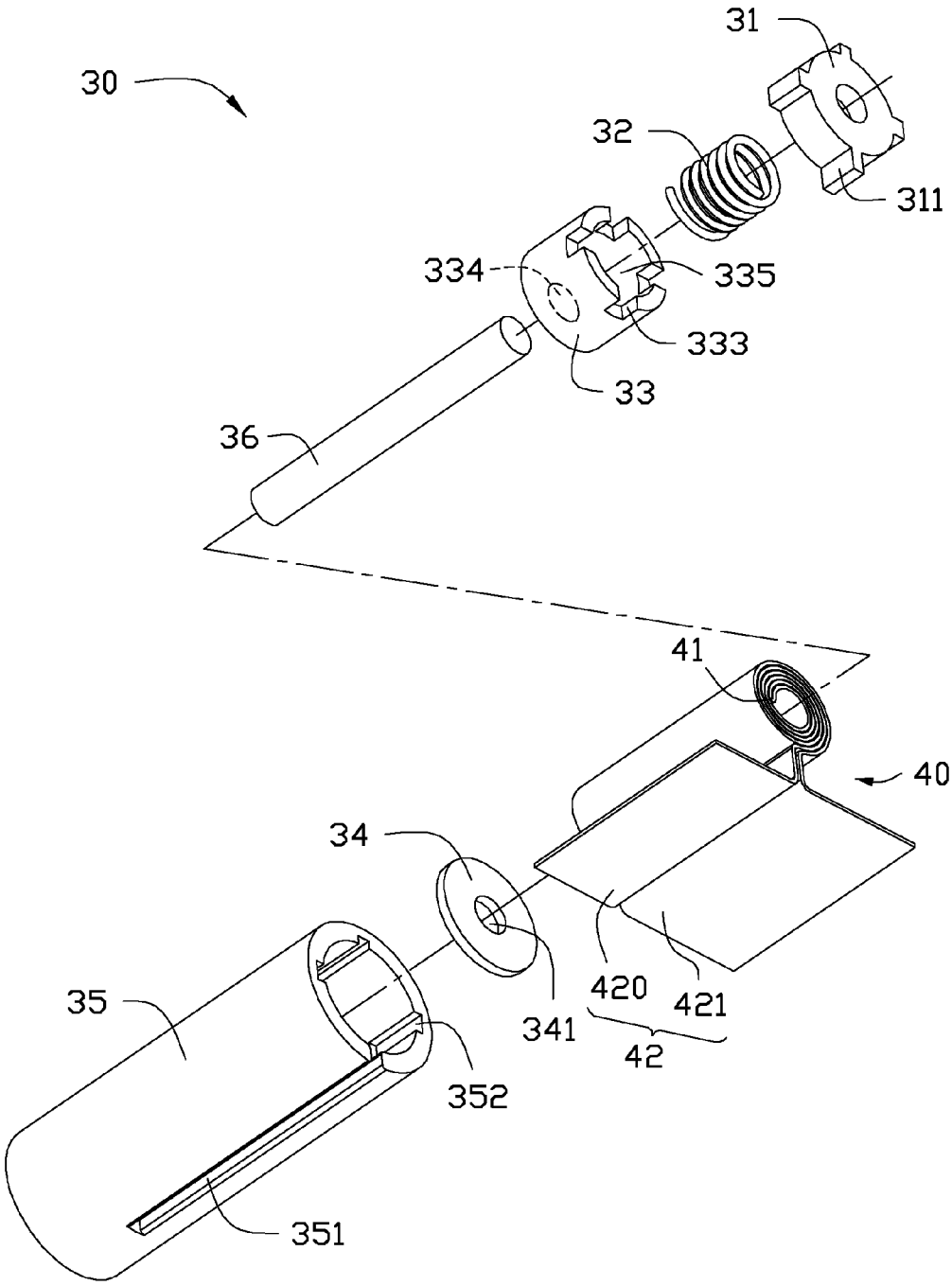
FIG. 3 is an exploded view of the strap connecting member of FIG. 2.
Figure 4:
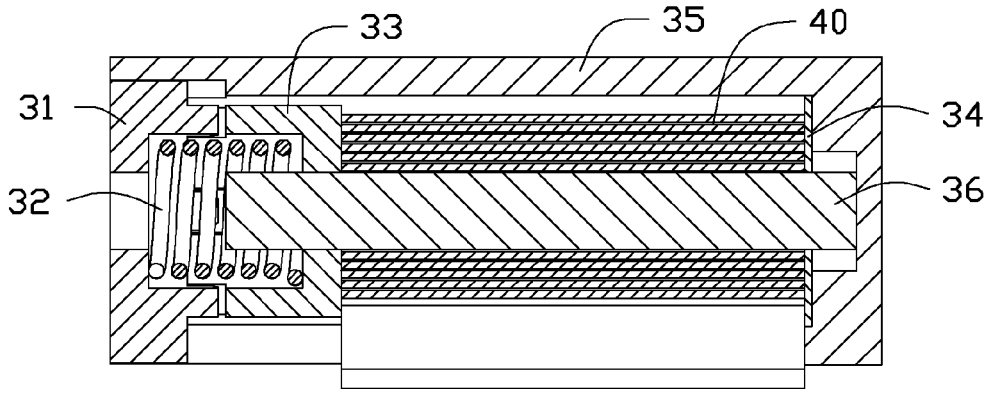
FIG. 4 is a cross-sectional view taken along line IV-IV of FIG. 2, showing the strap connecting member in a first position.

Referring to FIGS. 1-4, an embodiment of an electronic device with a strap connecting member (hereinafter the electronic device) 1 is illustrated. The electronic device 1 may be any wearable electronic device, such as a wristwatch, a mobile phone, or a computer.

The electronic device 1 includes a body 10, a wrapper 20, a strap connecting member 30, and a strap 40. The strap 40 is operable to connect to two ends of the body 20. The wrapper 20 is configured to pack the strap 40 and the strap connecting member 30. The wrapper 20 is divided into a first wrapper 21, a second wrapper 22, and a third wrapper 23. The first wrapper 21 and the third wrapper 23 respectively pack two ends of the strap 40. The second wrapper 22 packs the strap connecting member 30. In another embodiment, the electronic device 1 does not include the wrapper 20.

The strap connecting member 30 further includes a cover 31, a torsion spring 32, a connecting element 33, a washer 34, a receiving chamber 35, and a pin 36. The cover 31 is generally flat cylinder-shaped and covers the receiving chamber 35, and it defines a plurality of protruding portions 311 extending from its circumferential surface. The connecting element 33 defines the same number of recessed portions 333 corresponding to the protruding portions 311. The recessed portions 333 are engaged with the protruding portions 311. In the embodiment, the number of the protruding portions 311 is four.

One end of the torsion spring 32 is connected to the cover 31. The connecting element 33 defines a first through hole 334 in the bottom thereof and an accommodating space 335. The accommodating space 335 accommodates the torsion spring 32. One end of the pin 36 passes through the first through hole 334 and is connected to the other end of the torsion spring 32. The pin 36 may rotate relative to the connecting element 33.

The receiving chamber 35 accommodates the connecting element 33, the pin 36, and the washer 34. In the embodiment, the receiving chamber 35 is a cylindrical body. The receiving chamber 35 defines an opening notch 351 passing through the sidewall of the receiving chamber 35. The receiving chamber 35 further defines a plurality of latching notches 352 along the inner surface thereof. The opening notch 351 is engaged with one of the protruding portions 311 and the latching notches 352 are engaged with the other protruding portions 311. In the embodiment, the protruding portion 311 corresponding to the opening notch 351 is larger than the other protruding portions.

The receiving chamber 35 receives the washer 34 on a bottom thereof. The washer 34 defines a second through hole 341 in the middle thereof. The other end of the pin 36 passes through the second through hole 341 and is retained in the receiving chamber 35.

The strap 40 is folded from the middle thereof, that is, the strap 40 is double-layered, and forms two ends, namely a folded end 41 and an open end 42. The folded end 41 of the double-layered strap 40 is connected with the pin 36 and is wrapped around the pin 36, and the open end 42 of the double-layered strap 40 is separated into two portions 420, 421. The two portions 420, 421 pass at the opening notch 351 from the receiving chamber 35 and are respectively connected to the body 10. When the pin 36 is rotated along a first rotating direction under a first external force, such as a clockwise rotating direction, the length of the folding strap 40 becomes long. When the pin 36 is rotated along a second rotating direction opposite to the first rotating direction under a second external force, such as an anticlockwise rotating direction, the length of the folding strap 40 becomes short.

Before the cover 31 covers the receiving chamber 35, the torsion spring 32 is twisted and elastically deformed to generate a torsion force. When the cover 31 is engaged with the receiving chamber 35, the pin 36 is rotated relative to the connecting element 33 and the strap 40 automatically shrinks in the receiving chamber 35 under the torsion force. Accordingly, the length of the strap 40 becomes shorter.

Figure 5:
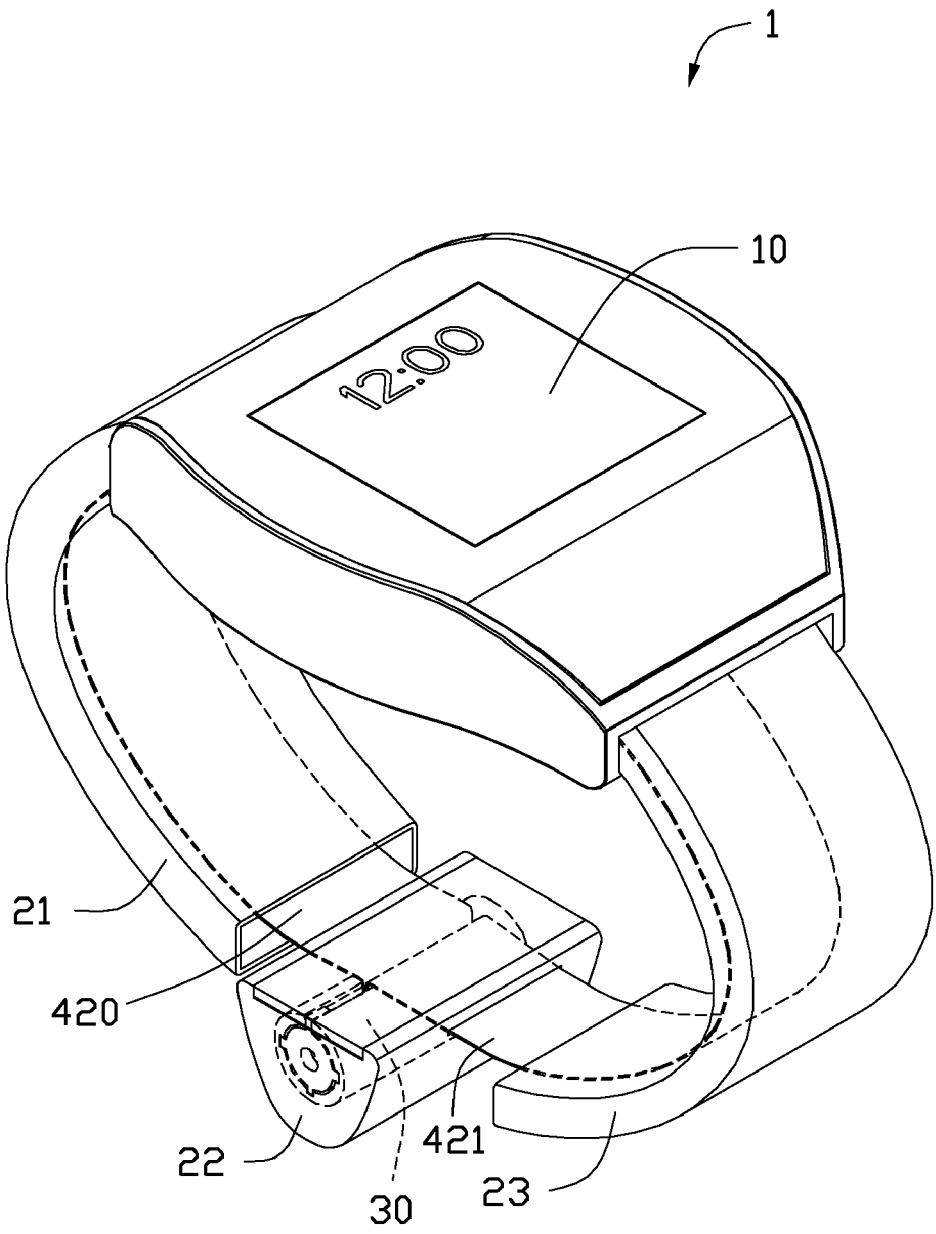
FIG. 5 is an isometric view of the electronic device loosening the strap connecting member of FIG. 1.

Referring to FIG. 5, while wearing the electronic device 1, the strap connecting member 30 is pulled and moved down under an external force from a user. For example, in the embodiment, the external force is put on the second wrapper 22, the pin 36 is rotated relative to the connecting element 33, the length of the strap 40 becomes longer, the torsion force of the torsion spring 32 is changed, and it is easy for the user to put on the electronic device 1. After putting on the electronic device 1, the strap 40 automatically shrinks in the receiving chamber 35 under the changed torsion force and presses close around the wrist of the user. According, the electronic device 1 may automatically adjust the length of the strap 40 according to the size of the wrist of each user under the torsion force of the torsion spring 32.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A strap connecting member utilized for an electronic device, the electronic device comprising a body, a strap operable to connect to two ends of the body, and the strap connecting member, the strap connecting member comprising:

a pin;

a torsion spring one end of which is connected to the pin;

a receiving chamber accommodating the pin and defining an opening notch passing through the sidewall thereof; and a cover connected with the torsion spring and engaged with the receiving chamber;

wherein the strap is double-layered, the double-layered strap forms a folded end and an open end, the folded end is connected with the pin and is wrapped around the pin, and the open end is separated into two portions which pass at the opening notch and are respectively connected to the body, when the torsion spring is elastically deformed and generates a torsion force, the pin is rotated and the strap automatically shrinks in the receiving chamber under the torsion force.

2. The strap connecting member as descried in claim 1, wherein the strap connecting member further comprises a connecting element defining a through hole in the middle thereof, the pin passes through the through hole and rotates relative to the connecting element, the cover defines a plurality of protruding portions around, the connecting element defines the same number of recessed portions corresponding to the protruding portions, and the recessed portions are engaged with the protruding portions.

3. The strap connecting member as described in claim 2, wherein the number of the protruding portions is four.

4. The strap connecting member as described in claim 2, wherein the opening notch is engaged with one protruding portion, the receiving chamber defines a plurality of latching notches along the inner surface thereof which engage with the other protruding portions.

5. The strap connecting member as described in claim 1, wherein the receiving chamber receives a washer therein, the washer defines a through hole in the middle thereof, the pin passes through the through hole and is retained in the receiving chamber.

6. An electronic device, comprising:

a body;

a strap operable to connect to two ends of the body; and a strap connecting member, comprising:

a pin;

a torsion spring one end of which is connected to the pin;

a receiving chamber accommodating the pin and defining an opening notch passing through the sidewall thereof; and a cover connected with the torsion spring and engaged with the receiving chamber;

wherein the strap is double-layered, the double-layered strap forms a folded end and an open end, the folded end is connected with the pin and is wrapped around the pin, and the open end is separated into two portions which pass at the opening notch and are respectively connected to the body, when the torsion spring is elastically deformed and generates a torsion force, the pin is rotated and the strap automatically shrinks in the receiving chamber under the torsion force.

7. The electronic device as descried in claim 6, wherein the strap connecting member further comprises a connecting element defining a through hole in the middle thereof, the pin passes through the through hole and rotates relative to the connecting element, the cover defines a plurality of protruding portions around, the connecting element defines the same number of recessed portions corresponding to the protruding portions, and the recessed portions are engaged with the protruding portions.

8. The electronic device as described in claim 7, wherein the number of the protruding portions is four.

9. The electronic device as described in claim 7, wherein the opening notch is engaged with one protruding portion, the receiving chamber defines a plurality of latching notches along the inner surface thereof which engage with the other protruding portions.

10. The electronic device as described in claim 6, wherein the receiving chamber receives a washer therein, the washer defines a through hole in the middle thereof, the pin passes through the through hole and is retained in the receiving chamber.

* * * * *